United States Patent [19]

Kleiner

[11] 4,385,646

[45] May 31, 1983

[54] READING AND LIFTING DEVICE FOR A CONTROL MACHINE

[75] Inventor: Walter Kleiner, Hirzel-Zuerich, Switzerland

[73] Assignee: Staeubli Ltd., Horgen-Zuerich, Switzerland

[21] Appl. No.: 236,482

[22] Filed: Feb. 23, 1981

[51] Int. Cl.[3] ..... D03J 1/00

[52] U.S. Cl. ..... 139/331; 139/68

[58] Field of Search ..... 139/331, 68, 59; 66/233, 231

[56] References Cited

U.S. PATENT DOCUMENTS

| | | | |
|---|---|---|---|
| 1,896,635 | 2/1933 | Lombardi | 66/233 |
| 2,193,969 | 3/1940 | Korber | 66/233 |
| 4,154,268 | 5/1979 | Schwarz | 139/331 X |

FOREIGN PATENT DOCUMENTS

| | | | |
|---|---|---|---|
| 614839 | 1/1961 | Italy | 139/331 |
| 391594 | 9/1965 | Switzerland | 139/331 |

*Primary Examiner*—James Kee Chi

*Attorney, Agent, or Firm*—Flynn, Thiel, Boutell & Tanis

[57] ABSTRACT

A reading and lifting device has a force amplifying bar which can be reciprocated vertically and is driven positively, and a reading needle is slidably supported therein. A pattern card with nonperforated and perforated points is provided below the force amplifying bar. When the needle hits a nonperforated point, the needle is moved back into the force amplifying bar. In one embodiment, the needle slides with its head on a surface which effects a swivelling of a lock member. Through this, an end of the lock member comes to lie in front of an offset portion of a control arm. The force amplifying bar during its downward movement then carries the control arm along against the force of a spring. The device facilitates the sensitive reading of a pattern card and the forceful passing on of the control information read.

6 Claims, 12 Drawing Figures

READING AND LIFTING DEVICE FOR A CONTROL MACHINE

CROSS-REFERENCE TO RELATED APPLICATION

This application is related to a co-pending application entitled "READING AND CONTROL DEVICE FOR A CONTROL MACHINE", Ser. No. 235 824, filed Feb. 19, 1981.

FIELD OF THE INVENTION

This invention relates to a reading and lifting device for a control machine which is controllable by a pattern card having holes or nonperforated points and has a reading needle for reading the pattern card and a force amplifying bar movable in the direction of movement of the reading needle, the reading needle being supported movably in the force amplifying bar to project toward the pattern card and being in operative contact with a lock member which is pivotally supported on the force amplifying bar for movement between two positions.

BACKGROUND OF THE INVENTION

To control any kind of machines, particularly in the textile industry, it is common to use pattern cards having holes or nonperforated points and made of paper, cardboard, plastic foil or a similar light material. These pattern cards save a lot of room and are handy to use, but they require careful handling. During intensive use, control errors can occur if the control points become damaged or notched due to the action of the reading needles and/or pressure exerted by the reading needles which is too strong. But it is also required of such controls that they be able to apply greater forces which influence a mechanical part.

Reading and control devices with a positively driven part, in which part the reading needle is supported, are already known.

The goal of the invention is to provide such a device, which works reliably and directly, namely quickly, particularly in machines in which one part is returned by a spring into its initial position after being controlled and driven.

SUMMARY OF THE INVENTION

This goal is achieved with a device of the foregoing type in which the lock member is constructed as at least a one-arm lever which is pivotally supported on a shaft on the force amplifying bar and is operably engageable on the one hand with the reading needle and on the other hand with a control arm, a spring being provided to move the control arm back to its initial position.

With this it is possible, simultaneously with the reading to a control point, to move the part which lowers the reading needle with respect to the reading needle so that it carries out firmly and automatically the appropriate control. This device works when the controlled part reaches again its initial position through the urging of a spring after a relief, namely, between a first and a second control.

BRIEF DESCRIPTION OF THE DRAWINGS

Exemplary embodiments of the subject matter of the invention are illustrated in the drawings, in which.

DETAILED DESCRIPTION

Figure 1:
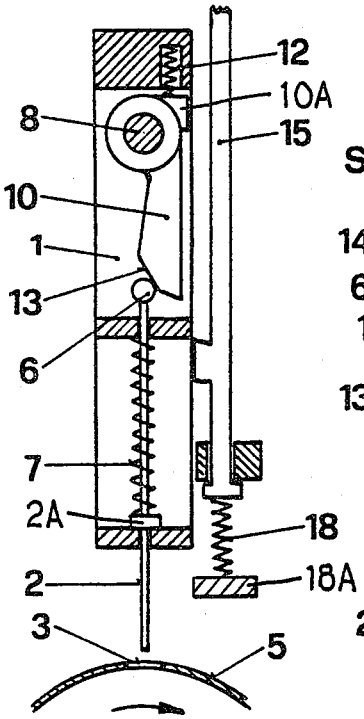
FIGS. 1 to 3 are sectional side views illustrating schematically in three positions of operation a first embodiment of a reading and lifting device having a one-arm lock member.

In all embodiments, a force amplifying bar 1 is a beam which is viewed sectionally in a longitudinal direction and extends over a plurality of control points, wherein at each control point there is provided one of the illustrated control mechanisms having a lock member which is pivotally supported for movement between an initial position and a pivoted position. The beam is moved firmly up and down in the axial direction of the reading needle 2 by a conventional and not-illustrated drive mechanism. The reading needle 2 is used to read the holes or perforated points 3 and nonperforated points 4 of a pattern card 5 and is vertically supported in openings in walls of the force amplifying bar for sliding movement in its axial direction. The reading needle 2 has a head 6 at its upper end. A relatively weak compression spring 7 is arranged between a wall of the bar 1 and a flange 2A of the reading needle 2 and urges the reading needle 2 downwardly, but permits the reading needle 2 to retreat into the force amplifying bar 1 when it hits a nonperforated point on the pattern card 5. A shaft 8 is part of the force amplifying bar 1 and pivotally supports a lock member which will be described later on.

Figure 2:
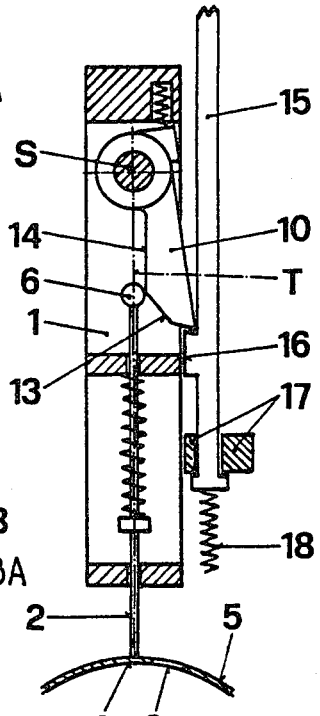
Figure 3:
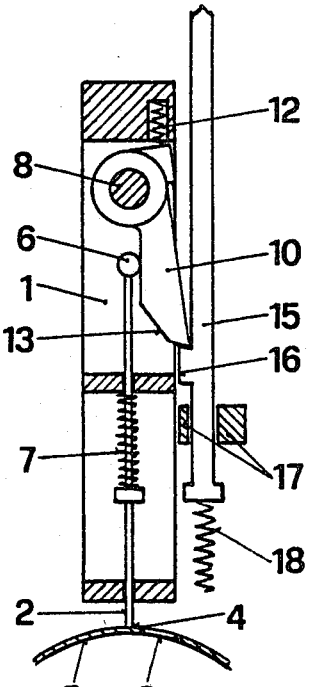

In the first exemplary embodiment according to FIGS. 1 to 3, the lock member 10 is a one-arm lever which is pivotally supported on the shaft 8. Between a projection 10A on the lock member 10 and a recess in a wall of the force amplifying bar 1 is arranged a spring 12 which pivotally urges an inclined surface 13 provided on the end of the arm of the lock member 10 against the head 6 of the reading needle 2. Adjacent the inclined surface 13, the arm has a sliding surface 14 for the head 6 which extends approximately radially with respect to the shaft 8 and is substantially aligned with the reading needle 2. The pivot axis S of the lock member 10 approximately intersects the extension of the axis T of the reading needle 2.

A control arm 15 is arranged parallel to the force amplifying bar 1, has an offset portion 16 which faces the lock member 10, and is supported slidingly in guides 17. A compression spring 18 arranged between a support 18A and the lower end of the arm 15 urges the control arm 15 upwardly toward the initial position illustrated in FIG. 1.

If the force amplifying bar 1 is lowered toward the pattern card 5 and the reading needle 2 enters a hole 3, then nothing changes positionally within the force amplifying mechanism from the position illustrated in FIG. 1. However, if the reading needle 2 hits a nonperforated point 4, then it is moved upwardly into the force amplifying bar 1, as shown in FIGS. 2 and 3. The head 6 slides along the inclined surface 13 of the arm of the lock member 10 and pivots the lock member 10 into the position shown in FIG. 2. Upon a further lowering of the force amplifying bar 1, the tip of the arm of the lock member 10 engages the offset portion 16 and presses the control arm 15 downwardly with a relatively large force without increasing the pressure exerted by the reading needle 2 onto the pattern card 5. Upon a lifting up of the force amplifying bar 1, the springs 18 and 7 respectively move the control arm 15 and the reading needle 2 back into the initial position of each shown in FIG. 1.

Various controls can be carried out with the control arm 15, and it is important that the control arm 15 is able to exert a relatively high pressure which is not directly possible through the reading needle alone. Such a control is, for example, used in shed-forming machines for the control of weaving machines, for the control of the color selector or thread distributor in weaving machines, and for controlling lateral movement of heddles or needles in a chain-edge apparatus. The control arm 15 is returned to the initial position (FIG. 1) after each downward movement by the spring 18.

Figure 4:
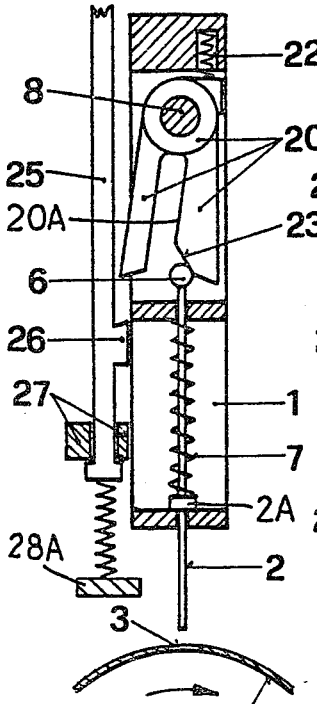
FIGS. 4 to 6 are sectional side views illustrating schematically in three positions of operation a second embodiment of a reading and lifting device having a two-arm lock member.
Figure 5:
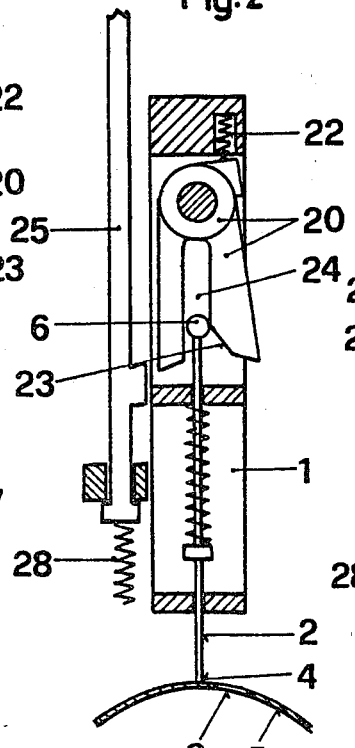
Figure 6:
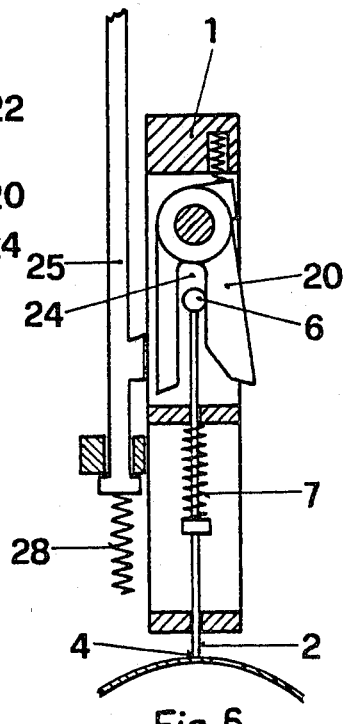

The exemplary embodiment according to FIGS. 4 to 6 illustrates a lock member 20 which is a two-arm lever, the lock member 20 under the urging of the spring 22 being pivoted clockwise so that the inclined surface 23 on the right arm of the lock member 20 is urged against the head 6 of the reading needle 2. The left arm of the lock member 20 thereby projects laterally outwardly beyond the force amplifying bar 1 toward a control arm 25.

The two arms of the lock member 20 extend downwardly substantially parallel to each other to define a downwardly facing slot 24 in which the head 6 of the reading needle 2 is received. The sloped surface 23 is provided within the slot 24 at the lower end thereof and a substantially radially extending sliding surface 20A is provided in the slot 24 adjacent the inclined surface 23. The control arm 25, guides 27, spring 28 and support 28A are functionally and structurally similar to the control arm 15, guides 17, spring 18 and support 19 of FIGS. 1–3 described hereinabove.

If the reading needle 2 of FIGS. 4–6 reads a hole 3 in the pattern card 5 during a lowering of the force amplifying bar 1, the pivotal position of the lock member 20 is not changed. The left arm of the lock member 20 engages the offset portion 26 of the control arm 25 and presses the control arm 25 downwardly to a position similar to that of the control arm 15 in FIG. 3.

If, however, the reading needle 2 reads a nonperforated point 4 (FIGS. 5 and 6), then the head 6 slides along the inclined surface 23 and the lock member 20 swivels in a counterclockwise direction, and then the head 6 slides further into the downwardly opening slot 24. The lock member 20 is held in this swivelled position until the bar 1 is raised and the control arm 25 is thus not pressed downwardly but remains in its raised position under the urging of the spring 28.

Figure 7:
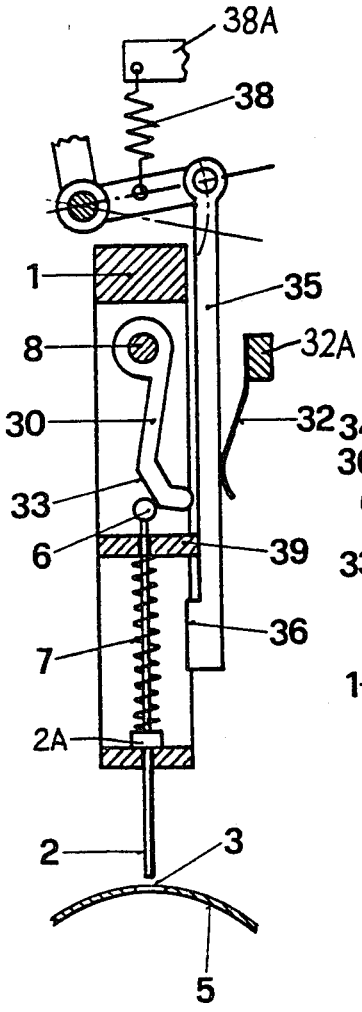
FIGS. 7 to 9 are sectional side views illustrating schematically in three positions of operation a third embodiment of a reading and lifting device having a pivotally supported control arm.
Figure 8:
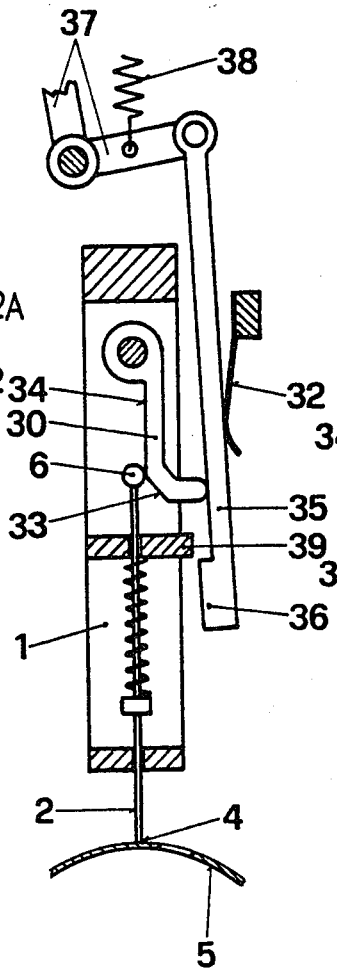
Figure 9:
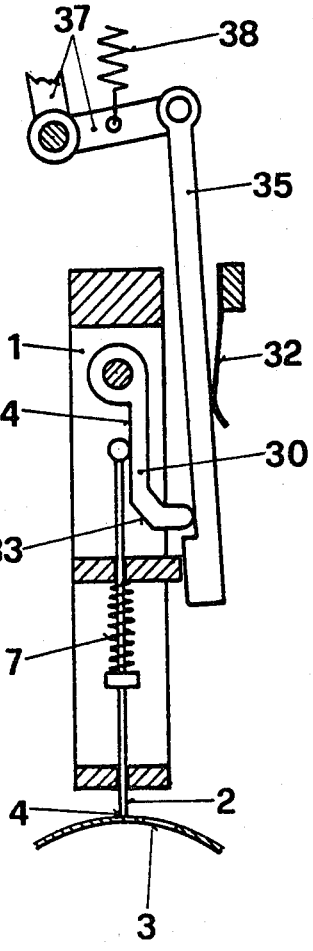

The exemplary embodiment according to FIGS. 7 to 9 has a lock member 30 similar to the lock member 10 in the FIGS. 1 to 3, but the control arm 35 is of differing structure.

The one-arm lock member 30 is pivotally supported on the shaft 8 of the force amplifying bar 1. It has an inclined surface 33 and a sliding surface 34 which cooperate with the head 6 of the reading needle 2. In the initial position of FIG. 7 or in the position in which the reading needle 2 reads a hole 3, the lock member 30 remains laterally within the force amplifying bar 1. The control arm 35 has an offset portion 36 and is hingedly connected to a pivotally supported two-arm control element 37. A spring 38 extending between a support 38A and an arm of the element 37 holds the control arm 35 in a lifted position, and a leaf spring 32 mounted in a support 32A presses the control arm 35 toward the lock member 30.

If the reading needle 2 reads a perforated point 3 during a lowering of the force amplifying bar 1, the control arm 35 remains uninfluenced until an outwardly projecting nose 39 on the force amplifying bar 1 engages the offset portion 36 and pulls the control arm 35 down parallel to the movement of the force amplifying bar 1. The lateral pressure exerted by the spring 32 facilitates this carrying along. When the force amplifying bar 1 then moves upwardly, the spring 38 acts through the elements 37 to pull the control arm 35 upwardly.

If the reading needle 2 reads a nonperforated point 4 during a lowering of the force amplifying bar 1, then its head 6 swings the lock member 30 to the right by sliding along the inclined surface 33 and holds the lock member in this position (FIG. 9) through engagement with the sliding surface 34. The outwardly extending tip of the arm of the lock 30 thereby pushes the control arm 35 outwardly away from the force amplifying bar 1, as shown in FIG. 9, so that the nose 39 slides past the offset portion 36. Thus, a control movement transmission or force transmission onto the two-arm control element 37 does not take place.

Figure 10:
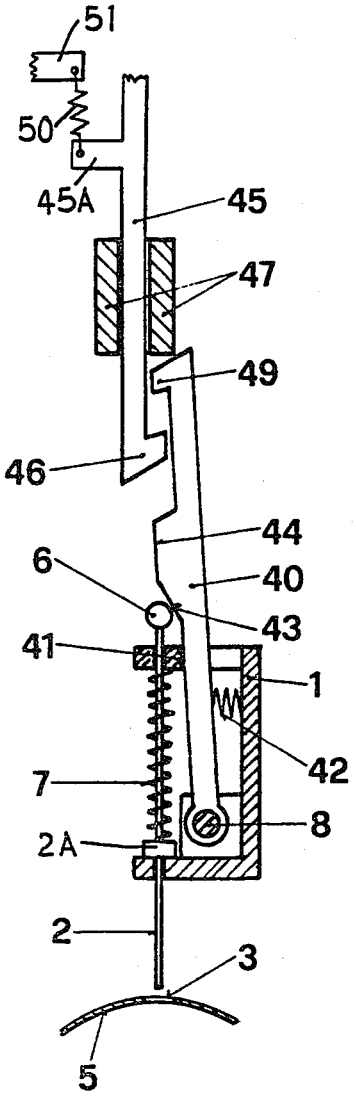
FIGS. 10 to 12 are sectional side views illustrating schematically in three positions of operation a fourth embodiment of a reading and lifting device having a hook on the lock member.
Figure 11:
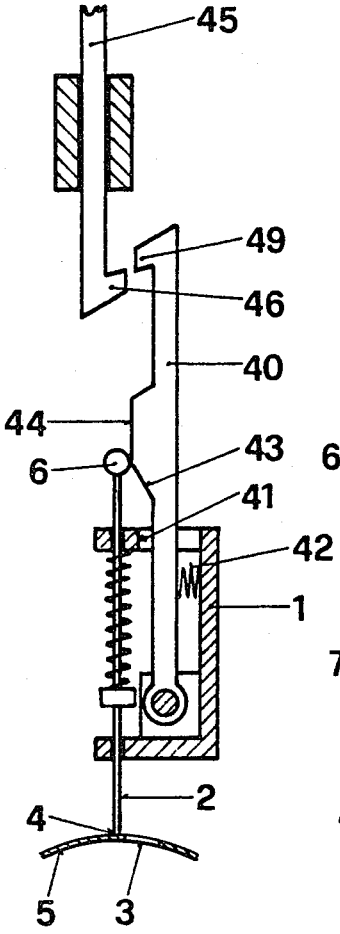
Figure 12:
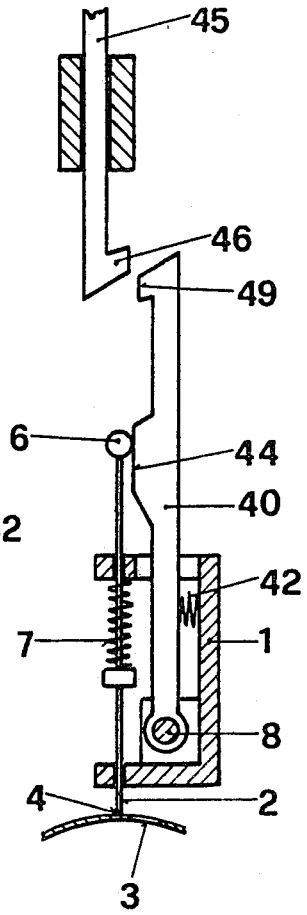

The force amplifying bar 1 in the exemplary embodiment according to FIGS. 10 to 12 is of simple structure. This permits a faster acceleration of its movement. In contrast to the previous embodiments, the arm of the lock member 40 is longer and has at its end a hook 49. The lock member 40 is pivotally supported on the shaft 8 of the force amplifying bar 1 and is biased by a compression spring 42 arranged between the lock member 40 and a wall of the force amplifying bar 1. In the initial position according to FIG. 10, the lock member 40 engages an edge 41 of the force amplifying bar 1 rather than the head 6 of the reading needle 2, which results in a small relief for the reading needle 2. A control arm 45 extends approximately in the same direction as the reading needle 2. It is supported in guides 47 and has a hook 46 on its lower end, which hook 46 engages or does not engage the arm of the lock member 40, depending on the pivotal position of the lock member 40.

The control arm 45 has a flange 45A and a spring 50 arranged between the flange 45A and a stationary support 51 urges the control arm 45 upwardly.

The entire structure of the embodiment of FIGS. 10–12 extends in height instead of width and permits a space-saving installation where, for example in the case of dobbies, there is more vertical space available.

If the reading needle 2 reads a hole 3, then the force amplifying bar 1 is lowered without a change in the position of its inner mechanism and the control arm 45 is pulled downwardly by the lock member 40 (FIG. 10).

If, however, the reading needle 2 reads a nonperforated point 4, then the lock member 40 pivots to the right against the force of the spring 42, due to the sliding of the head 6 of the reading needle 2 over the inclined surface 43 and the sliding surface 44. The hooks 46 and 49 of the control arm 45 and the lock member 40 do not engage, but pass each other side by side, as shown in FIGS. 11 and 12.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A reading and lifting device which is responsive to a pattern card having perforated and nonperforated points, comprising a force amplifying assembly supported for movement toward and away from said pattern card in a first direction between first and second positions, said force amplifying assembly being closer to said pattern card in said second position than in said first position, a reading needle projecting toward and engageable with said pattern card and supported on said force amplifying assembly for movement relative thereto between an initial position and an actuated position, means for yieldably urging said reading needle toward said initial position thereof, engagement of said needle with a nonperforated point of said pattern card as said force amplifying means moves from said first to said second position causing said needle to move from said initial position to said actuated position, a control member independently supported adjacent said force amplifying assembly for movement between an initial position and an advanced position in directions approximately parallel to said first direction, means responsive to movement of said needle relative to said force amplifying assembly for operatively coupling said force amplifying assembly and said control member when said needle is in one of said initial and actuated positions for effecting movement of said control member from said initial position to said advanced position in response to movement of said force amplifying assembly from said first to said second position, and means for moving said control member to said initial position thereof as said force amplifying assembly moves from said second to said first position.

2. The device according to claim 1, including an offset provided on said control member, and wherein said means for operatively coupling said force amplifying assembly and said control member includes a lock member pivotally supported on said force amplifying assembly and operatively engaged by said reading needle, said lock member moving between third and fourth positions in response to movement of said reading needle between said initial and actuated positions, respectively, said lock member having a portion engageable with said offset on said control member when said lock member is in one of said third and fourth positions for effecting said operative coupling of said force amplifying assembly and said control member.

3. The device according to claim 2, wherein said reading needle has a head at the end thereof remote from said pattern card which slidably engages a surface provided on said lock member, said surface including adjacent portions which respectively extend substantially radially of the pivot axis of said lock member and at an incline with respect to said reading needle.

4. The device according to claim 3, wherein said reading needle extends substantially radially of the pivot axis of said lock member, and including a spring cooperable with said force amplifying assembly and lock member for urging said lock member toward said third position.

5. The device according to claim 1, including an offset provided on said control member, and wherein said means for operatively coupling said force amplifying assembly and said control member includes a nose provided on said force amplifying assembly, includes said control member being supported for movement transversely of said first direction toward and away from said nose on said force amplifying assembly between third and fourth positions, includes resilient means yieldably urging said control member toward one of said third and fourth positions, and includes a lock member pivotally supported on said force amplifying assembly and operatively engaged by said reading needle, said lock member moving between fifth and sixth positions in response to movement of said reading needle between said initial and actuated positions, respectively, said lock member having a portion engageable with said control member for moving said control member toward the other of said third and fourth positions as said lock member moves toward said sixth position, said nose being engageable with said offset when said control member is in one of said third and fourth positions for effecting said operative coupling of said force amplifying assembly and said control member.

6. The device according to claim 1, wherein said means for moving said control member to said initial position thereof as said force amplifying assembly moves from said second to said first position includes a stationary support and a spring cooperable with said stationary support and said control member to continuously, yieldably urge said control member toward said initial position thereof.

* * * * *

UNITED STATES PATENT AND TRADEMARK OFFICE

CERTIFICATE OF CORRECTION

PATENT NO. : 4 385 646

DATED : May 31, 1983

INVENTOR(S) : Walter Kleiner

It is certified that error appears in the above-identified patent and that said Letters Patent is hereby corrected as shown below:

On the title page, immediately below the line in the left column which sets forth the filing date, please add the following:

---[30] Foreign Application Priority Data
Feb. 26, 1980 [CH] Switzerland....1510/80---.

Signed and Sealed this

*Thirty-first* Day of *January 1984*

[SEAL]

*Attest:*

GERALD J. MOSSINGHOFF

*Attesting Officer*

*Commissioner of Patents and Trademarks*